US009761079B1

(12) United States Patent
Lin

(10) Patent No.: US 9,761,079 B1
(45) Date of Patent: Sep. 12, 2017

(54) DUAL DISPENSING HAND SANITIZER KIOSK

(71) Applicant: Daniel Lin, San Francisco, CA (US)

(72) Inventor: Daniel Lin, San Francisco, CA (US)

( * ) Notice: Subject to any disclaimer, the term of this patent is extended or adjusted under 35 U.S.C. 154(b) by 0 days.

(21) Appl. No.: 15/603,726

(22) Filed: May 24, 2017

Related U.S. Application Data

(63) Continuation-in-part of application No. 14/274,854, filed on May 12, 2014, now Pat. No. 9,693,661, which is a continuation-in-part of application No. 13/526,363, filed on Jun. 18, 2012, now Pat. No. 8,746,299, which is a continuation of application No. 12/582,882, filed on Oct. 21, 2009, now Pat. No. 8,225,823.

(51) Int. Cl.
*B65B 1/04* (2006.01)
*G07F 13/02* (2006.01)

(52) U.S. Cl.
CPC ..... *G07F 13/025* (2013.01)

(58) Field of Classification Search
CPC ..... A47K 5/1217; G07F 11/64
USPC ..... 7/98, 360; 141/1
See application file for complete search history.

*Primary Examiner* — Jason K Niesz

(57) ABSTRACT

A hand sanitizer dispenser dispenses two types of hand sanitizer product. The dispenser comprises a first compartment to store single-use hand sanitizer product and a second compartment to store packaged hand sanitizer product. For example, packaged hand sanitizer product can be sold using embodiments of this dispenser to offset the costs of providing single-use hand sanitizer product as a courtesy.

20 Claims, 2 Drawing Sheets

DUAL DISPENSING HAND SANITIZER KIOSK

CROSS-REFERENCE TO RELATED APPLICATIONS

This application is a continuation-in-part of U.S. patent application Ser. No. 14/274,854, entitled "Dual Dispensing Hand Sanitizer Device," filed on May 12, 2014, which is a continuation-in-part of U.S. Pat. No. 8,746,299, entitled "Hand Sanitizer Device for Fuel Pump Dispenser," filed on Jun. 18, 2012 and issued on Jun. 10, 2014 which is a continuation of U.S. Pat. No. 8,225,823, entitled "Hand Sanitizer Device for Fuel Pump Dispenser," filed on Oct. 21, 2009 and issued on Jul. 24, 2012, all of which are hereby incorporated by reference.

BACKGROUND

Hand sanitizer dispensers are increasingly being placed in various facilities, such as retail stores and supermarket entrances, shopping plazas, business lobbies, airport terminals, doctor offices and hospital service desks and the like. Such establishments provide these hand sanitizer dispensers as a benefit to their customers to encourage cleanliness inside the facilities and reduce the spread of pathogens. However, the costs of the dispensers as well as the ongoing cost of refilling them with hand sanitizer product are typically borne by the establishments.

To defray some of these costs, certain businesses have arisen around providing hand sanitizer equipment and product to the establishments for free or at a subsidized costs. In order to subsidize the cost, some of these businesses provide the hand sanitizing equipment and supply attached to advertising signage. Advertisers who are willing to pay these business for advertising on the signage thereby subsidize the cost of the hand sanitizer for the facilities. Nevertheless, advertising may not sufficiently subsidize the costs of providing such hand sanitizer services or may not otherwise be appropriate in certain facilities where the provision of courtesy hand sanitizers may be desired. For example, a doctor's office or hospital may not desire advertising attached to a courtesy hand sanitizer.

SUMMARY

One or more embodiments of the present invention provide a hand sanitizer dispenser comprising a housing configured to dispense only hand sanitizer product, the housing further comprising a first compartment within the housing to store single-use hand sanitizer product (e.g., a portion of gel or foam or a moist wipe, etc.) and a second compartment within the housing to store packaged hand sanitizer product (e.g., a bottle of hand sanitizer). A first dispensing outlet is coupled to the first compartment to dispense single-use hand sanitizer product and a second dispensing outlet coupled to the second compartment to dispense packaged hand sanitizer product. In certain embodiment, the hand sanitizer dispenser further includes payment receiving mechanisms such as a magnetic stripe readers and/or other hardware as further discussed herein to facilitate payment for a purchase of packaged hand sanitizer product. In this manner, for example, the single-use hand sanitizer product may be provided at a lower cost by offsetting these costs with the revenues from the sale of packaged hand sanitizer product.

Alternative embodiments of the present invention provide a hand sanitizer kiosk for dispensing hand sanitizer product. The kiosk comprises a display panel that has a first housing to store single-use hand sanitizer product and a second housing to store packaged hand sanitizer product. Similar to the dispenser embodiments, in these kiosk embodiment, the first housing comprises a first dispensing outlet to dispense single-user hand sanitizer product and the second housing comprises a second dispensing outlet to dispense packaged hand sanitizer product.

DETAILED DESCRIPTION

Figure 1:
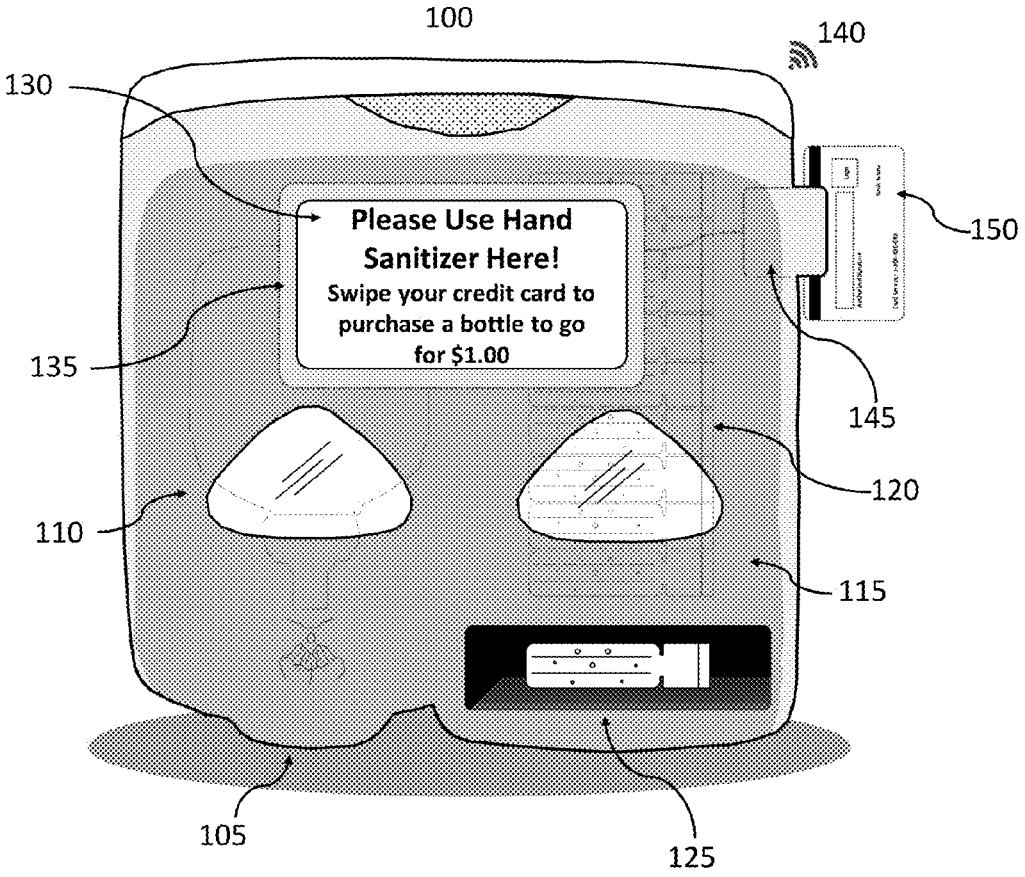
FIG. 1 depicts a hand sanitizer dispenser according to one embodiment.

FIG. 1 depicts a hand sanitizer dispenser according to one embodiment. Hand sanitizer dispenser 100 may be used in many environments, such as airports, shopping malls, supermarkets, hospitals, doctors' offices and any other environment where persons may desire sanitizing their hands. As depicted in the embodiment of FIG. 1, hand sanitizer dispenser 100 only dispenses hand sanitizer. In particular, hand sanitizer dispenser 100 dispenses liquid-based sanitizer product (e.g., gels, foams, etc.) from a dispensing outlet 105 and may be either touch free (e.g., electronically controlled to recognize the presence of a hand underneath) or manually triggered (e.g., through a lever or button, etc.). Alternative embodiments may provide alternative single-use hand sanitizer products such as wipes or moist towelettes. Hand sanitizer dispenser 100 comprises an integrated housing that includes a compartment 110 to store liquid based sanitizer and includes another compartment 115 to store a number of hand sanitizer bottles 120 or other sealed and/or packaged hand sanitizer product that can be dispensed from a second dispensing outlet 125 (e.g., squeeze tubes, etc.). In one embodiment, the liquid-based sanitizer product dispensed from dispensing outlet 105 may be offered for free as a courtesy to users. Similarly, the packaged hand sanitizer product may also be offered as a courtesy or for promotional purposes to users in certain establishments. For example, an establishment providing dispenser 100 or an interested advertiser may desire to brand hand sanitizer bottles 120 that are dispensed from dispenser 100 for promotional purposes. In one such embodiment, a sponsor may decide to provide a number of dispensers 100 situated around the floor of a trade show or convention to promote cleanliness and also distribute bottles of hand sanitizer branded by the sponsor. In such embodiments, dispenser 100 may include a badge scanner or other ID scanner (generally referred to as badge scanners), which when successfully scanning a badge or identification, dispenses a bottle of hand sanitizer. In this manner, the sponsor is able to collect a number of customer leads in exchange for offering promotional hand sanitizer dispensers.

In alternative embodiments, the packaged hand sanitizer product may be purchased through dispenser 100. Individuals who are likely to approach hand sanitizer dispenser 100 to cleanse their hands are likely also more predisposed to purchasing a bottle of hand sanitizer. Purchase of bottles of hand sanitizers may exhibit characteristics of an "impulse" purchase and providing the opportunity to purchase bottles of hand sanitizer at dispenser 100 may increase the likelihood of a purchase by an individual. In one such environment, the manufacturer of hand sanitizer dispenser 100 may offer hand sanitizer dispenser 100 (and future refills for liquid-based sanitizer product) to establishments at a reduced price (or even as a courtesy) because the costs are offset by the ability to directly sell bottles of hand sanitizer to users of hand sanitizer dispenser 100. In another environment, the establishment itself may sell the bottles of hand sanitizer in an effort to subsidize the cost of purchasing refills of the liquid-based sanitizer product (and may be provided the opportunity to "brand" hand sanitizer bottles 120). In yet another environment, third party hand sanitizer providers, such as advertisers, may provide dispenser 100 to an establishment in order to additionally sell bottles of hand sanitizers that would help offset costs.

As such, in the embodiment of FIG. 1, bottled hand sanitizers 120 may be purchased and dispensed from second dispensing outlet 125 at a price. Hand sanitizer 100 also includes a touch screen 130 (or other screen with accompanying buttons or other user interface in other embodiments) that is programmed to display instructions to individuals who desire to purchase a bottle of hand sanitizer. Touch screen 130 may be part of or coupled to a computer system 135 embedded in hand sanitizer dispenser 100 that is configured to display purchase instructions on the touch screen 130 and consummate a point-of-sale transaction with the consumer. In one embodiment, computer system 135 may have WiFi or cellular networking capabilities 140 to enable mobile payments transacted using the Internet. For example, computer system 135 may include a point-of-sale application running on the Android mobile operating system or any other similar mobile operating system. In the embodiment of FIG. 1, computer system 135 further includes a coupled magnetic stripe reader 145 to enable individuals to swipe their payment cards 150 (credit cards, debit cards, identification cards, etc.) to pay for a purchase. It should be recognized that other computer hardware for other types of payment receiving mechanisms, such as an NFC (near field communications) enabled payments reader for wireless payments or EMC or similar chip card readers may be provided additionally or in the alternative in other embodiments. Alternative embodiments may include a badge, member account or identification card scanner or other identification input device to link a purchaser's identity to an employee or member financial account. For example, a health club may place a number of dispensers 100 throughout the club, encouraging members of the club to purchase a bottle of hand sanitizer branded by the health club. The point-of-sale application in computer system 135 in such dispensers 100 may enable the member to input their membership number or scan their membership card (and thereby add the cost of the purchase of the bottle to their monthly bill, for example). In yet other embodiments, a bill or coin acceptor to accept cash payments from individuals as their payment receiving mechanisms. Similarly, while the computer system 135 of FIG. 1 is embedded into hand sanitizer 100, it should recognized in alternative embodiment that computer system 135 may be situated outside of hand sanitizer dispenser 100 but proximately situated in order to engage the mechanisms inside hand sanitizer dispenser 100 to dispense a bottle of hand sanitizer from dispensing outlet 125 upon a successful purchase by an individual.

Figure 2:
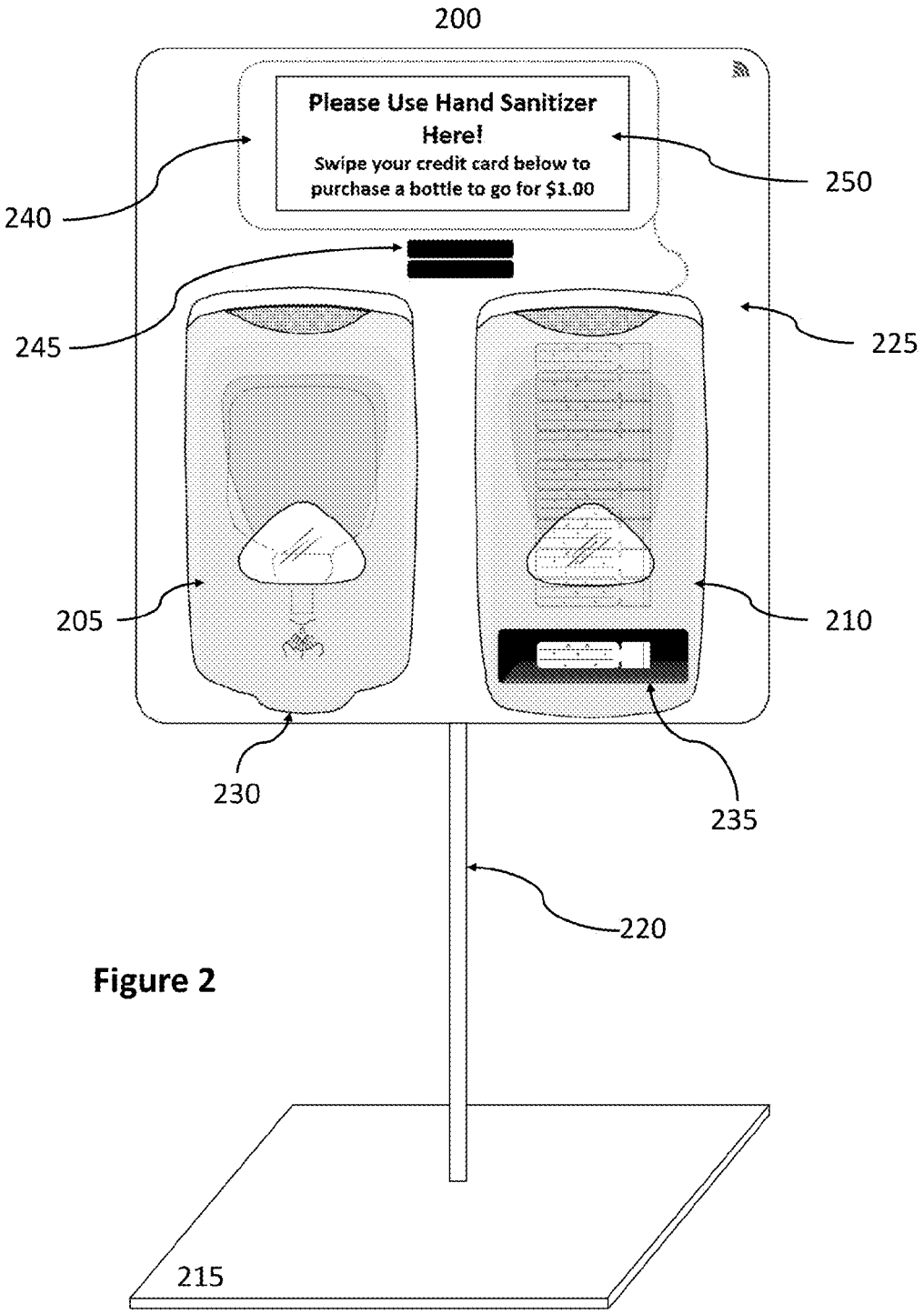
FIG. 2 depicts a hand sanitizer kiosk according to one embodiment.

While FIG. 1 depicted a hand sanitizer dispenser that includes a housing that accommodates both the liquid hand sanitizer as well as the purchased hand sanitizer, the embodiment of FIG. 2 depicts a hand sanitizer kiosk 200 that includes a dispenser 205 for dispensing liquid-based or other single-use sanitizer product and a separate dispenser 210 for dispensing hand sanitizer bottles or other sealed and/or packaged hand sanitizer product that is housed separately from the liquid-based sanitizer product. Similar to the hand sanitizer dispenser 100 in FIG. 1, kiosk 200 in the embodiment of FIG. 2 only dispenses hand sanitizer. The kiosk 200 comprises a base stand 215 and a tube or pipe 220 extending from base stand 215 to a display panel 225. Display panel 225 includes dispenser 205 which is proximately situated next to dispenser 210. Similar to hand sanitizer dispenser 100, dispenser 205 provides liquid-based or other single-use hand sanitizer product (e.g., for free or as a courtesy, in one embodiment) through dispensing outlet 230 and may be either touch free (e.g., electronically controlled to recognize the presence of a hand underneath) or manually triggered (e.g., through a lever or button, etc.). Similarly, second dispenser 210 provides hand sanitizer bottles or other sealed and/or packaged hand sanitizer product (e.g., for purchase, in one embodiment) that can be dispensed from its dispensing outlet 235. Display panel 225 also similarly includes a computer system 240 that is electronically coupled to second dispenser 210 and includes a point-of-sale application and coupled payment receiving hardware 245 (e.g., magnetic stripe reader, wireless NFC reader, EMV chip card reader, etc.) to facilitate a purchase of packaged hand sanitizer from a patron. Display panel 225 further includes a touch screen display 250 coupled to computer system 240 that provides advertising as well as a user-interface for the point-of-sale application. It should be recognized that alternative embodiments of kiosk 200 may have a static advertising display and a smaller digital display for point-of-sale transactions (perhaps embedded into dispenser 210 in some embodiments). Similarly, it should further be recognized that alternative embodiments of kiosk 200 may not include a base and tube, but may simply comprise a display panel 220, that can, for example, be mounted directly on a wall. Alternative embodiments may also have computer system 240, display panel 225 and payment receiving hardware 245 embedded into second dispenser 210. In other alternative embodiment, second dispenser may include badge scanning or similar ID scanning capabilities, for example, to scan in attendees' badges at a trade show or convention (e.g., to gather as leads for a salesforce). When an attendee, for example, scans his badge into the dispenser's scanner, one embodiment of dispenser 210 may trigger the dispensing of a packaged hand sanitizer as a promotional item.

It should be recognized that various modifications and changes may be made to the specific embodiments described herein without departing from the broader spirit and scope of the invention as set forth in the appended claims. For example, while the embodiments herein focus on hand sanitizer product as the only product that is dispensed from the dispensers or kiosks described herein, it should be recognized that alternative products that can be provided in both single-use and packaged form (e.g., soap, etc.) can be provided in alternative embodiments. Similarly, capabilities such as badge scanning that are described in the context of kiosk 200 may be also provided with dispenser 100. In certain embodiment, the point-of-sale computer systems and screens of the dispensers and kiosks herein may be solar powered in certain embodiments. Although one or more embodiments of the present invention have been described in some detail for clarity of understanding, it will be apparent that certain changes and modifications may be made within the scope of the claims. Accordingly, the described embodiments are to be considered as illustrative and not restrictive, and the scope of the claims is not to be limited to details given herein, but may be modified within the scope and equivalents of the claims. In the claims, elements and/or steps do not imply any particular order of operation, unless explicitly stated in the claims.

I claim:

1. A hand sanitizer dispenser comprising a housing configured to dispense only hand sanitizer product, the housing further comprising a first compartment within the housing to store single-use hand sanitizer product;

a second compartment within the housing to store packaged hand sanitizer product;

a first dispensing outlet coupled to the first compartment to dispense single-use hand sanitizer product; and a second dispensing outlet coupled to the second compartment to dispense packaged hand sanitizer product.

2. The hand sanitizer dispenser of claim 1, wherein the single-use hand sanitizer product is liquid-based hand sanitizer and the packaged hand sanitizer is bottled hand sanitizer.

3. The hand sanitizer dispenser of claim 1, further comprising a badge scanner.

4. The hand sanitizer dispenser of claim 3, wherein the bottled hand sanitizer is branded by an advertiser or an establishment providing the dispenser.

5. The hand sanitizer dispenser of claim 4, wherein the packaged hand sanitizer is provided for promotional purposes.

6. The hand sanitizer dispenser of claim 1, further comprising a computer system configured to provide a point-of-sale application to enable the purchase of packaged hand sanitizer product.

7. The hand sanitizer dispenser of claim 6, further comprising payment receiving hardware to receive payment from a purchaser.

8. A hand sanitizer kiosk for dispensing only hand sanitizer product, the kiosk comprising display panel further comprising:

a first housing to store single-use hand sanitizer product, wherein the first housing comprises a first dispensing outlet to dispense single-user hand sanitizer product;

a second housing to store packaged hand sanitizer product, wherein the second housing comprises a second dispensing outlet to dispense packaged hand sanitizer product.

9. The hand sanitizer kiosk of claim 8, wherein the display panel further includes a computer system coupled to the second housing and configured to provide a point-of-sale application to enable the purchase of packaged hand sanitizer product.

10. The hand sanitizer kiosk of claim 9, wherein the display panel further includes an electronic display coupled to the computer system.

11. The hand sanitizer kiosk of claim 10, wherein the display panel further includes payment receiving hardware to receive payment from a purchaser.

12. The hand sanitizer kiosk of claim 8, wherein the packaged hand sanitizer is branded by an establishment providing the kiosk or an advertiser.

13. A hand sanitizer dispenser comprising a housing to store only packaged hand sanitizer product, wherein the housing further comprises a dispensing outlet to dispense the packaged hand sanitizer product.

14. The hand sanitizer dispenser of claim 13, further coupled to a second housing to store single-use hand sanitizer product, wherein the second housing comprises a second dispensing outlet to dispense single-use hand sanitizer product.

15. The hand sanitizer dispenser of claim 13, further secured to a display panel further securing a second dispenser comprising a second housing to store single-use hand sanitizer product, wherein the second housing further comprises a second dispensing outlet to dispense single-use hand sanitizer product.

16. The hand sanitizer dispenser of claim 13, further comprising a computer system to provide a point-of-sale application to enable the purchase of packaged hand sanitizer product.

17. The hand sanitizer dispenser of claim 13, wherein the computer system is powered by solar cells.

18. The hand sanitizer dispenser of claim 16, further comprising payment receiving hardware to receive payment from a purchaser.

19. The hand sanitizer dispenser of claim 13, further comprising badge scanning hardware.

20. The hand sanitizer dispenser of claim 19, wherein the packaged hand sanitizer is branded by an advertiser.

* * * * *